US005163871A

United States Patent [19]

Huibregtse et al.

[11] Patent Number: 5,163,871

[45] Date of Patent: Nov. 17, 1992

[54] FLOOR REGISTER GRILL

[76] Inventors: Robert Huibregtse, 6090 Galpin Lake Rd., Shorwood, Minn. 55331; Lawrence C. Shaw, 6440 County Rd. 15, Mound, Minn. 55364

[21] Appl. No.: 679,280

[22] Filed: Apr. 2, 1991

[51] Int. Cl.[5] ..... F24F 13/08

[52] U.S. Cl. ..... 454/289; 454/309

[58] Field of Search ..... 454/275, 277, 289, 309, 454/284, 290, 299, 905, 319

[56] References Cited

U.S. PATENT DOCUMENTS

| | | | |
|---|---|---|---|
| 458,854 | 9/1891 | Mark . | |
| 637,519 | 11/1899 | Mertins | 454/289 X |
| 1,101,641 | 6/1914 | Lenling . | |
| 1,380,980 | 6/1921 | Lane . | |
| 1,390,347 | 9/1921 | Elliston . | |
| 1,652,128 | 12/1925 | Hare . | |
| 1,678,748 | 7/1928 | Smith . | |
| 2,158,074 | 5/1939 | Kilb . | |
| 2,216,420 | 9/1940 | Rose . | |
| 2,663,246 | 12/1953 | Smith . | |
| 2,720,152 | 10/1955 | Ball | 454/309 |
| 2,887,034 | 5/1959 | Görth . | |
| 2,962,956 | 12/1960 | Magyar . | |
| 3,559,560 | 2/1971 | Trahan | 454/299 |
| 4,936,400 | 6/1990 | Blumbach et al. | D23/387 X |
| 4,989,502 | 2/1991 | Ospelt | 454/277 X |

*Primary Examiner*—Harold Joyce
*Attorney, Agent, or Firm*—Kinney & Lange

[57] ABSTRACT

An air register grill includes a plurality of air directing vanes. Each air directing vane includes an air directing curve which meets one side of the grill at a substantially 90° angle. Opposing each air directing side is a relief side which generally mirrors the shape of the air directing side. This configuration provides an air stream which exits the grill at a generally 90° angle with the grill. Furthermore, air flow is not seriously impeded and the resultant grill structure provides an aesthetically pleasing design.

14 Claims, 2 Drawing Sheets

FLOOR REGISTER GRILL

BACKGROUND OF THE INVENTION

The present invention relates to a grill for covering floor registers used in air duct systems.

Forced air heating and cooling systems have found widespread use in modern day homes. Forced air systems use a central furnace (or air conditioner) which is connected to various rooms in a house through numerous air ducts. The furnace includes a fan to force air through the duct system. The furnace heats the air (or cools the air in the case of centralized air conditioning) which is directed throughout the house. Air emerges from outlets or registers in the duct work. The register is used to regulate the flow of air and includes an air flow control which is essentially a valve. Air duct registers which are situated in a floor are typically covered with a grill. The register grill allows the register to be stepped upon and provides an aesthetically pleasing appearance to the outlet.

There is a continuing need for floor register grills which provide improved airflow characteristics and which are aesthetically pleasing.

SUMMARY OF THE INVENTION

The present invention is a grill for a floor register such as those used in forced air heating/cooling systems. The grill of the present invention is designed to direct air flow in a generally upward direction from the floor register without significantly impeding air flow from the register. The grill is aesthetically pleasing and hides underlying duct work from view. Furthermore, the grill of the present invention has a thin profile and mounts flush with the surrounding floor.

The air register grill of the present invention comprises a generally planar grill. The grill includes a plurality of longitudinally separated air vanes. A space is provided between each adjacent pair of air vanes for passage of air. Each air vane includes an air directing side, a relief side, and top and bottom sides. The relief side is opposite the air directing side. Therefore, the relief side of one air vane faces the air directing side of an adjacent air vane. Each air directing side includes an air directing curve which forms a varying angle with a horizontal plane taken relative to the plane of the floor register grill. This angle ranges from something less than 90° at a bottom, or inlet side of the grill, to about 90° at a top, or outlet side of the grill. The relief side of each air vane also forms a relief side curve which is generally a mirror image of the air directing curve. The air directing curve causes air flow to be directed upwardly from the floor register grill. The relief side of the air vane increases spacing between adjacent air vanes and improves air flow through the grill. Furthermore, the curved air vanes of the present invention provide an aesthetically pleasing design which obscures underlying duct work from view.

In one embodiment of the present invention, the grill is divided laterally into two halves. On each half of the grill, the air directing curves face toward the center of the grill. This configuration provides two parallel air streams which are bent upwardly using the present invention. This configuration uses a central air vane which includes two relief sides. Furthermore, each end of the grill has an air vane with only an air directing side.

DETAILED DESCRIPTION OF THE PREFERRED EMBODIMENTS

Figure 1:
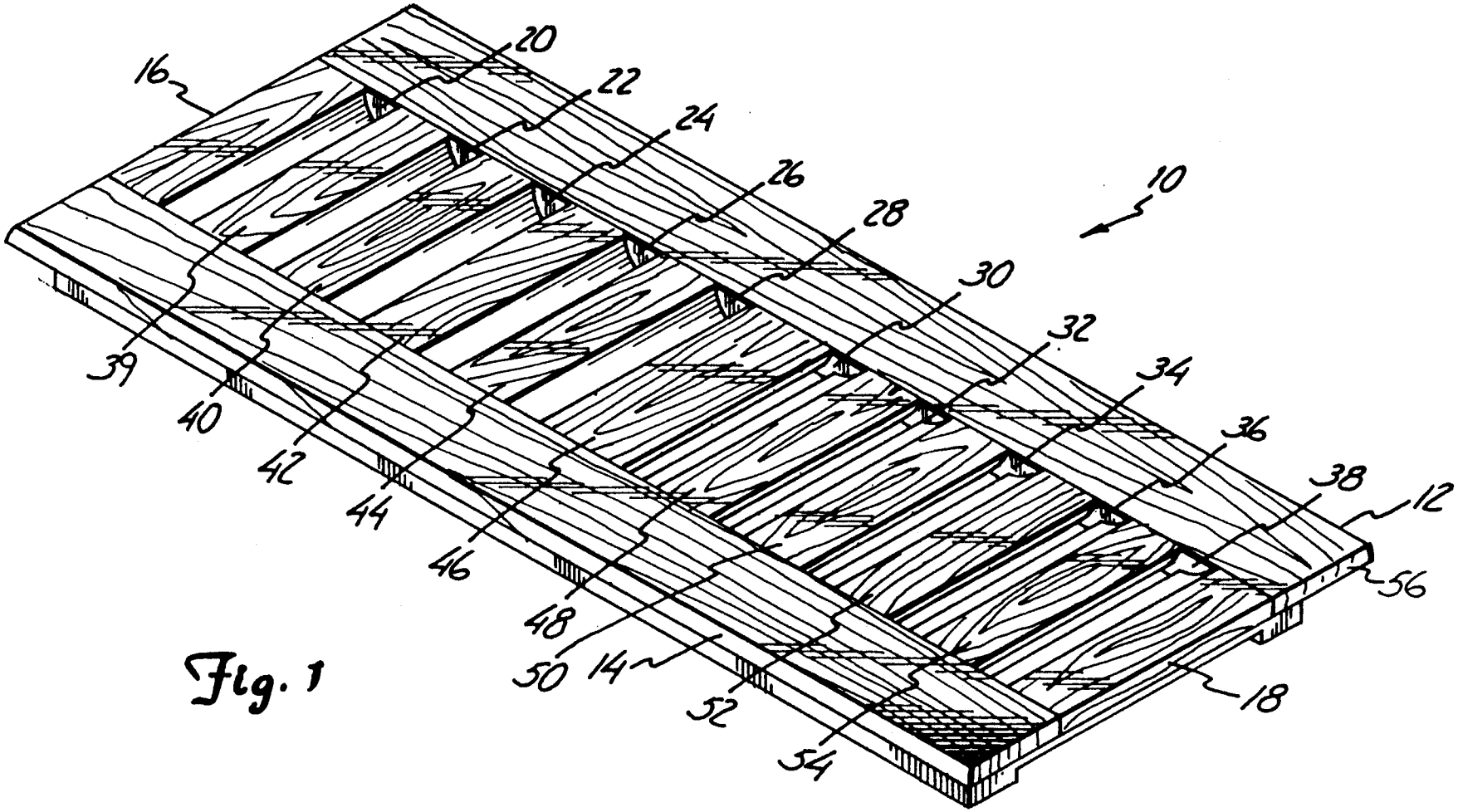
FIG. 1 is a plan view of a floor register grill in accordance with the present invention.

FIG. 1 is a plan view of a floor register grill 10 in accordance with the present invention. Floor register grill 10 includes longitudinal rails 12 and 14. Grill 10 also includes end air vanes 16 and 18. Extending between rails 12 and 14 are openings 20, 22, 24, 26, 28, 30, 32, 34, 36 and 38. Separating openings 20, 22, 24, 26 and 28 are air vanes 39, 40, 42 and 44. Separating openings 28 and 30 is central air vane 46. Separating openings 30, 32, 34, 36 and 38 are air vanes 48, 50, 52 and 54. Grill 10 also includes a lip 56 which extends around a perimeter of grill 10 defined by rails 12 and 14 and end vanes 16 and 18.

Figure 2:
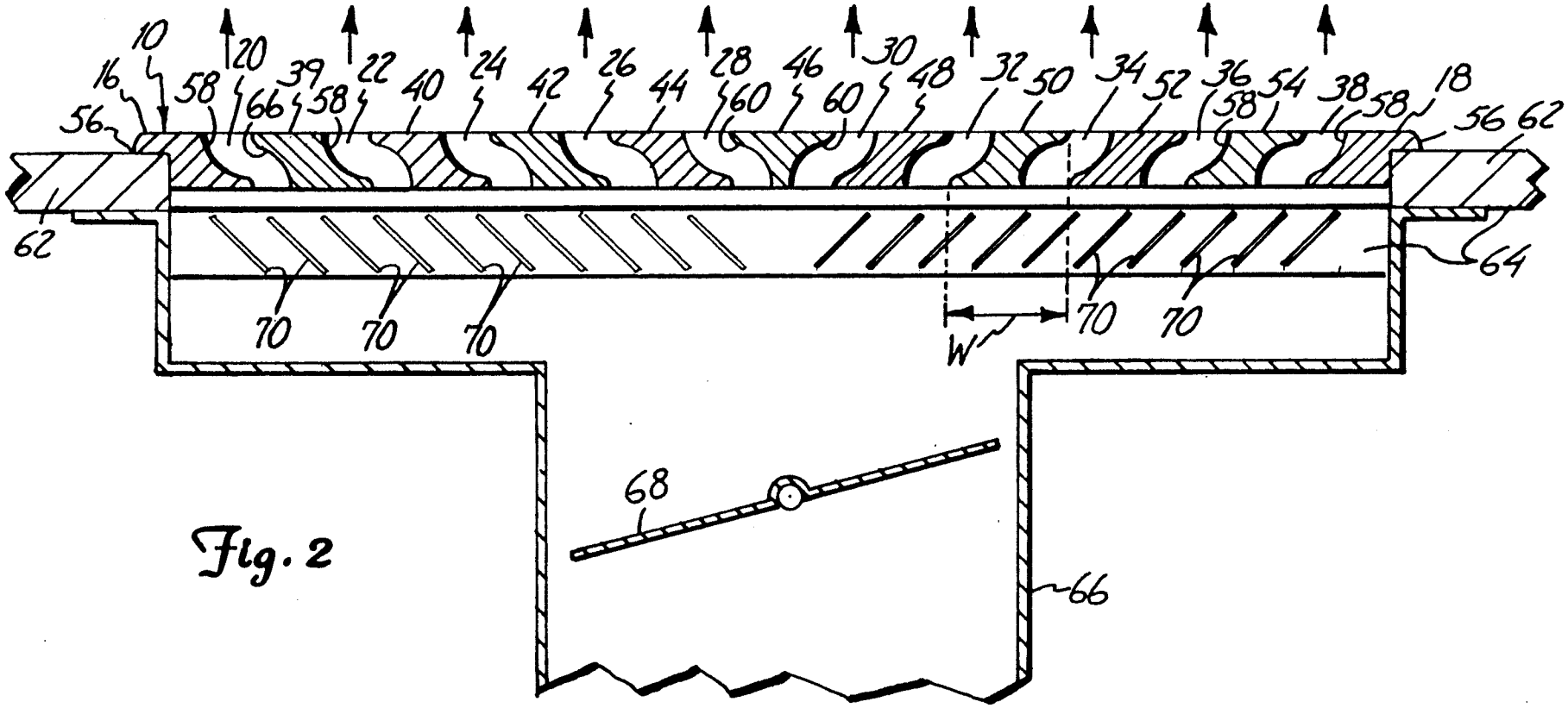
FIG. 2 is a cross sectional view taken laterally through a floor register grill made in accordance with the present invention.

FIG. 2 is a cross-sectional view of floor register 10. FIG. 2 shows cross-sectional views of end air vanes 16 and 18, air vanes 39, 40, 42, 44, 48, 50, 52 and 54, and central vane 46. In accordance with the present invention, each air vane includes an air directing side 58 and a relief side 60. End air vanes 16 and 18 include air directing sides 58 but do not include relief sides. Central air vane 46 includes two relief sides 60 which are associated with air directing sides 58 on air vanes 44 and 48.

Air register grill 10 is designed to direct air flow in the direction indicated by the air flow arrows shown in FIG. 2. Typically, air flow may form an angle of about 40° with the plane of grill 10. Using opening 20 as an example, air flow enters opening 20 between air directing side 58 of end vane 16 and relief side 60 of adjacent air vane 39. Air enters opening 20 from the side of grill 10 which is labeled "bottom" and exits from the side labeled "top." Air directing curve 58 extends between the bottom side to the top side of grill 10. Near the bottom side of grill 10, curve 58 forms an angle with the plane of grill 10 of substantially 0°. Moving from the bottom side to the top side of grill 10, curve 58 varies from 0° to about 90° with the plane of grill 10. Therefore, at the top side of grill 10, air directing side 58 is substantially vertical with respect to a horizontal plane formed by grill 10. Relief side 60 is generally a mirror image of air directing side 58 so that the angle formed by side 60 is substantially 90° at the bottom side of grill 10 and substantially 0° at the top side.

Air register grill 10 is divided in half at central vane 46. On the left side of central vane 46, openings 20, 22, 24, 26 and 28 extend between the bottom and the top of grill 10 in a direction generally from right to left. On the right hand side of central vane 46, openings 30, 32, 34, 36 and 38 extend between the bottom and the top of grill 10 in a direction generally from left to right.

As shown in FIG. 2, grill 10 fits between floor boards 62. Below air register grill 10 is air register 64, air duct 66 and air flow control valve 68. Air flow is provided through air duct 66 to grill 10. Air flow is controlled by changing the position of air flow control valve 68. Lip 56 is designed so that grill 10 securely seats in floor 62. Typically, register 64 comprises a metal grate with air directing fins 70.

In operation, air directing sides 58 and relief sides 60 of grill 10 direct air flow generally vertically from a horizontal plane defined by grill 10. Air flow is received by grill 10 from air duct 66 and is bent in a generally vertical direction by air directing sides 58. The configuration of air directing side 58 and relief side 60 obscures register 64 from view and provides an aesthetically pleasing air flow outlet. Relief sides 60 tend to be mirror images of air directing sides 58. This decreases impedance to air flow through grill 10. Air directing side 58 defines an air directing curve which forms a varying angle with a horizontal plane defined by grill 10. The air directing angle ranges from less than 90° at the bottom side of grill 10 to about 90° at the top side of grill 10. In a preferred embodiment, the angle between the air directing curve and the horizontal plane is approximately 0° closest the bottom side of grill 10.

Although FIG. 2 shows grill 10 extending above the plane of floor 62, grill 10 can also be flush mounted with floor 62. The present invention provides a relatively thin profile while still maintaining the desired air flow characteristics. This permits flush mounting between grill 10 and floor 62. In another embodiment, grill 10 can be directly inserted into air duct 66.

In one embodiment of the present invention, the distance between rails 12 and 14 (i.e. the length of vanes 16, 18, and 39 through 54) is about 3 inches. A width "W" shown in FIG. 2 is about 1-3/16 inches. A height from the bottom sides to the top sides of vanes 16, 18, and 39 through 54 is about 0.5 inches.

In the present invention, openings 20 through 38 form "S" shaped passageways. Air directing side 58 (and relief side 60) forms an arc of about 45°. This arc is a portion of a circle of radius 3 inches. The spacing between air directing side 58 and an adjacent relief side 60 is about 0.5 inches. Thus, openings 20 through 38 have an "S" shape with a height to ratio of about 0.5 inches to about 0.5 inches which equals 1.0. In the embodiment shown in FIG. 2, the "S" shaped openings form 90° angles at both the top and bottom sides of grill 10.

Although the present invention has been described with reference to preferred embodiments, workers skilled in the art will recognize that changes may be made in form and detail without departing from the spirit and scope of the invention. For example, the grill of the present invention can be mounted in walls as well as floors.

What is claimed is:

1. An air register grill which defines a plane, the air register grill comprising:

a pair of generally parallel rails;

a plurality of longitudinally spaced air vanes extending between the rails for directing air flow, including:

an air directing side associated with one of the plurality of air vanes, wherein the air directing side extends between a bottom side of the grill and a top side of the grill and the air directing side is designed to direct an air form in a direction for the bottom side to the top side; and an air directing curve associated with the air directing side which defines a varying angle relative to the plane of the air register grill, wherein the varying angle is generally 90° closest the top side of the grill; and a central air vane which has curved first and second relief sides, wherein the curved first and second relief side curve in opposite directions.

2. The air register grill of claim 1 wherein at least one of the plurality of air vanes which is adjacent to the air directing side includes a relief side which is generally a mirror image of the air directing side.

3. The air register grill of claim 1 including first and second end vanes on opposite ends of the air register grill, wherein the first and second end vanes include air directing sides which curve in opposite directions.

4. The air register grill of claim 1 wherein the varying angle is less than 90° closest the bottom side of the grill.

5. The air register grill of claim 1 wherein the grill is adapted to cover duct work, and adjacent air vanes of the plurality of air vanes are configured to obscure the duct work from view.

6. A grill for directing air flow from an air duct, comprising:

a first rail extending longitudinally and including first and second ends;

a second rail extending longitudinally and including first and second ends, wherein the second rail is spaced apart from the first rail and extends parallel with the first rail, the first and second rails defining a longitudinal plane;

a plurality of air vanes extending between and spaced along the first and second rails for directing air flow between a bottom side of the grill and a top side of the grill;

a central air vane which has curved first and second relief sides wherein the curved first and second relief sides curve in opposite directions;

an air directing side associated with a first side of each of the air vanes and extending between the bottom side and the top side of the grill wherein the air directing side includes a curve which forms a varying angle with the longitudinal plane and the varying angle is substantially 90° closes the top side of the grill; and a relief side associated with a second side of each of the air vanes, wherein the relief side is curved generally opposite the air directing side.

7. The grill of claim 6 including first and second end vanes on opposite ends of the first and second rails, wherein the first and second end vanes include air directing sides which curve in opposite directions.

8. The grill of claim 6 wherein the varying angle is less than 90° closest the bottom side of the grill.

9. The grill of claim 6 wherein the grill is adapted to cover duct work, and adjacent air vanes of the plurality of air vanes are configured to obscure the duct work from view.

10. An air register grill which defines a plane, the air register grill comprising:

a pair of generally parallel rails;

a plurality of longitudinally spaced air vanes extending between the rails for directing air flow, including:

an air directing side associated with one of the plurality of air vanes, wherein the air directing side extends between a bottom side of the grill and a top side of the grill and the air directing side is designed to direct an air flow in a direction from the bottom side to the top side; and an air directing curve associated with the air directing side which defines a varying angle relative to the plane of the air register grill, wherein the varying angle is generally 90° closest the top side of the grill; and a first and a second end vane on opposite ends of the air register grill, wherein the first and second end vanes include air directing side which curve in opposite directions.

11. An air register grill which defines a plane, the air register grill comprising:

a pair of generally parallel rails;

a plurality of longitudinally space air vanes extending between the rails for directing air flow, including:

a first air vane having a first curved side and a second side having a curve in a direction opposite that of the first curved side, the curves of the first and second sides generally extending between a bottom side of the grill and a top side of the grill; and a second air vane, adjacent the first air vane, having first and second curved sides similar to the first air vane, wherein the second side of the first air vane is aligned with the first side of the second air vane so as to define a generally "S" shaped air flow passage between the bottom side of the grill and the top side of the grill.

12. The air register grill of claim 11 and further including a left air vane section and a right air vane section, wherein the "S" shaped air flow passages of the left air vane section are positioned in mirror symmetry to the "S" shaped air flow passages of the right air vane section.

13. An air register grill which defines a plane, the air register grill comprising:

a pair of generally parallel rails;

plurality of air vanes coupled to and longitudinally spaced along the rails, wherein at least one of the air vanes has curved first and second sides which extend between a bottom surface and a top surface of the grill, the curve of the first side directed opposite the curve of the second side.

14. The air register grill of claim 13 wherein the curved first and second sides of the air vanes on a right half of the grill are in mirror symmetry to the curves on the first and second sides of the air vanes on a left half of the grill.

* * * * *

UNITED STATES PATENT AND TRADEMARK OFFICE

CERTIFICATE OF CORRECTION

PATENT NO. : 5,163,871

DATED : November 17, 1992

INVENTOR(S) : ROBERT HUIBREGTSE, LAWRENCE C. SHAW

It is certified that error appears in the above-identified patent and that said Letters Patent is hereby corrected as shown below:

Col. 3, line 57, delete "form", insert "flow"

Col. 5, line 1, delete "side", insert "sides"

Col. 6, line 10, before "plurality", insert "a"

Signed and Sealed this

Thirtieth Day of November, 1993

Bruce Lehman

*Attest:*

BRUCE LEHMAN

*Attesting Officer*

*Commissioner of Patents and Trademarks*